US009487270B2

(12) United States Patent
Sliwinski

(10) Patent No.: US 9,487,270 B2
(45) Date of Patent: Nov. 8, 2016

(54) FLOATING UNIT

(71) Applicant: Wojskowy Instytut Techniki Inzynieryjnej im. profesora Jozefa Kosackiego, Wroclaw (PL)

(72) Inventor: Janusz Sliwinski, Wroclaw (PL)

(73) Assignee: WOJSKOWY INSTYTUT TECHNIKI INZYNIERYJNEJ, Wroclaw (PL)

( * ) Notice: Subject to any disclaimer, the term of this patent is extended or adjusted under 35 U.S.C. 154(b) by 0 days.

(21) Appl. No.: 14/721,000

(22) Filed: May 26, 2015

(65) Prior Publication Data

US 2016/0016640 A1 Jan. 21, 2016

(30) Foreign Application Priority Data

Jun. 18, 2014 (PL) ..... 408599

(51) Int. Cl.

| | |
|---|---|
| ***B63B 1/04*** | (2006.01) |
| ***B63B 3/10*** | (2006.01) |
| ***B63C 11/44*** | (2006.01) |
| *B63B 35/00* | (2006.01) |

(52) U.S. Cl.

CPC . *B63B 3/10* (2013.01); *B63B 1/04* (2013.01); *B63C 11/44* (2013.01); *B63B 2035/001* (2013.01)

(58) Field of Classification Search

CPC ..... B63B 3/10; B63B 1/04
USPC ..... 114/68
See application file for complete search history.

(56) References Cited

U.S. PATENT DOCUMENTS

| | | | | |
|---|---|---|---|---|
| 3,871,317 | A * | 3/1975 | Szpytman | B63B 1/12 114/282 |
| 4,340,004 | A * | 7/1982 | Kanei | B63B 1/10 114/289 |
| 6,877,450 | B2 * | 4/2005 | Schmidt | B63B 1/04 114/61.13 |
| 7,194,972 | B2 * | 3/2007 | Schmitz, Sr. | B63B 1/10 114/61.1 |
| 7,634,971 | B2 * | 12/2009 | Lucas | B63B 1/08 114/61.15 |
| 8,166,899 | B1 * | 5/2012 | Min | B63B 1/38 114/67 A |
| 8,915,762 | B2 * | 12/2014 | Mostert | B63B 1/12 114/61.15 |
| 2007/0176429 | A1 * | 8/2007 | Lomerson, Sr. | F03B 13/1815 290/53 |
| 2008/0083364 | A1 * | 4/2008 | Taylor | B63B 59/02 114/360 |
| 2010/0064959 | A1 * | 3/2010 | Huang | B63B 1/38 114/67 A |
| 2016/0016640 | A1 * | 1/2016 | Sliwinski | B63C 11/44 114/68 |

* cited by examiner

*Primary Examiner* — Lars A Olson
*Assistant Examiner* — Jovon Hayes
(74) *Attorney, Agent, or Firm* — Mark M. Friedman

(57) ABSTRACT

A floating unit comprising: a hull having a recess in which a deployable wall is mounted, the wall being movable between a first and a second position; wherein in the first position the wall is enclosed within the hull in the recess, and in the second position the wall at least partly protrudes from the hull, thereby defining a partly enclosed space; and wherein the floating unit further comprises means for supplying air to the partly enclosed space, the partly enclosed space being configured to constitute an underwater air pocket upon supplying the air from the means for supplying the air when the floating unit floats in the water with the wall in the second position.

3 Claims, 4 Drawing Sheets

FLOATING UNIT

TECHNICAL FIELD

There is disclosed a floating unit having improved resistance to explosions, designed in particular for transportation and landing of soldiers, combat vehicles and other military equipment during military operations, in offshore zones and in inland waters.

BACKGROUND

Structural designs of floating units with improved resistance to explosions have not been described in professional literature so far.

SUMMARY

The floating unit has a hull which comprises in the bottom part, at its periphery, a recess in which a shield is placed. Further there are hydraulic cylinders, which are connected with one end to the hull and with the other end to the shield. A compressor unit with a non-return valve and a hose is mounted to the hull, wherein one end of the hose is connected with the hole in the hull's bottom. In other words, the hose connects the compressor unit with the hole in the hull.

There is disclosed a floating unit comprising: a hull having a recess in which a deployable wall is mounted, the wall being movable between a first and a second position; wherein in the first position the wall is enclosed within the hull in the recess, and in the second position the wall at least partly protrudes from the hull, thereby defining a partly enclosed space; and wherein the floating unit further comprises means for supplying air to the partly enclosed space, the partly enclosed space being configured to constitute an underwater air pocket upon supplying the air from the means for supplying the air when the floating unit floats in the water with the wall in the second position.

The means for supplying the air may comprise a compressor unit.

The wall can be activated by hydraulic cylinders.

BRIEF DESCRIPTION OF FIGURES

Further details and features of the present invention, its nature and various advantages will become more apparent from the following detailed description of the preferred embodiments shown in a drawing, in which.

DETAILED DESCRIPTION

Figure 1:
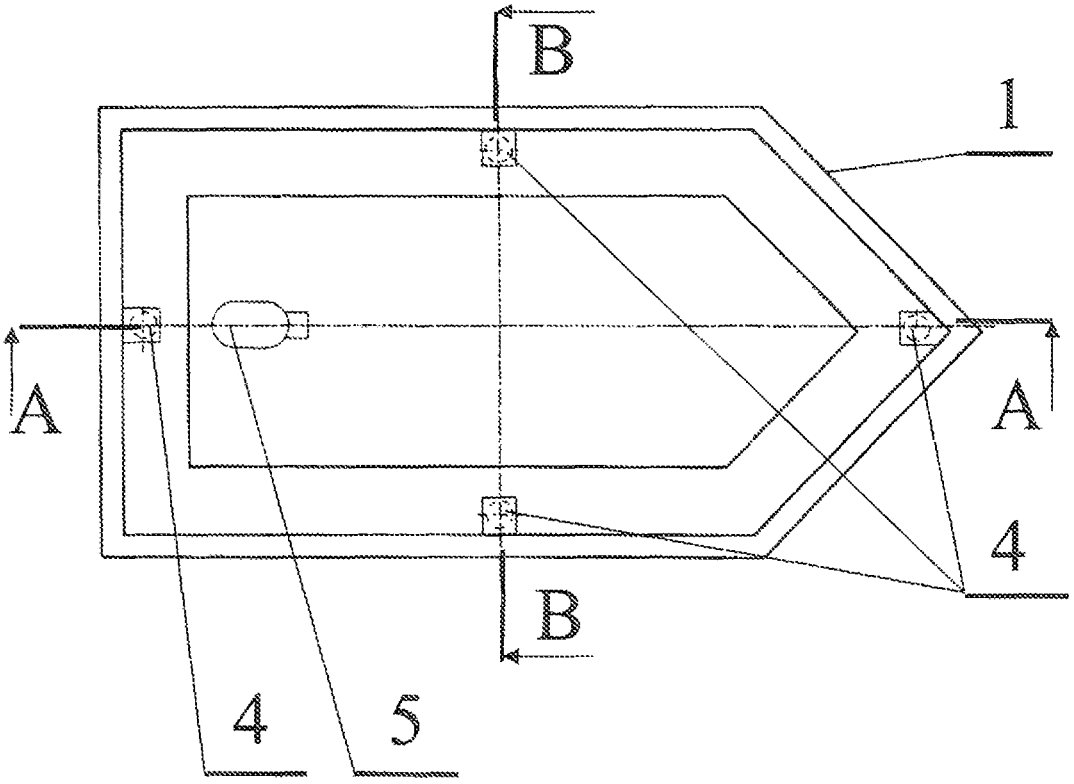
FIG. 1 shows the floating unit in a top view.
Figure 2:
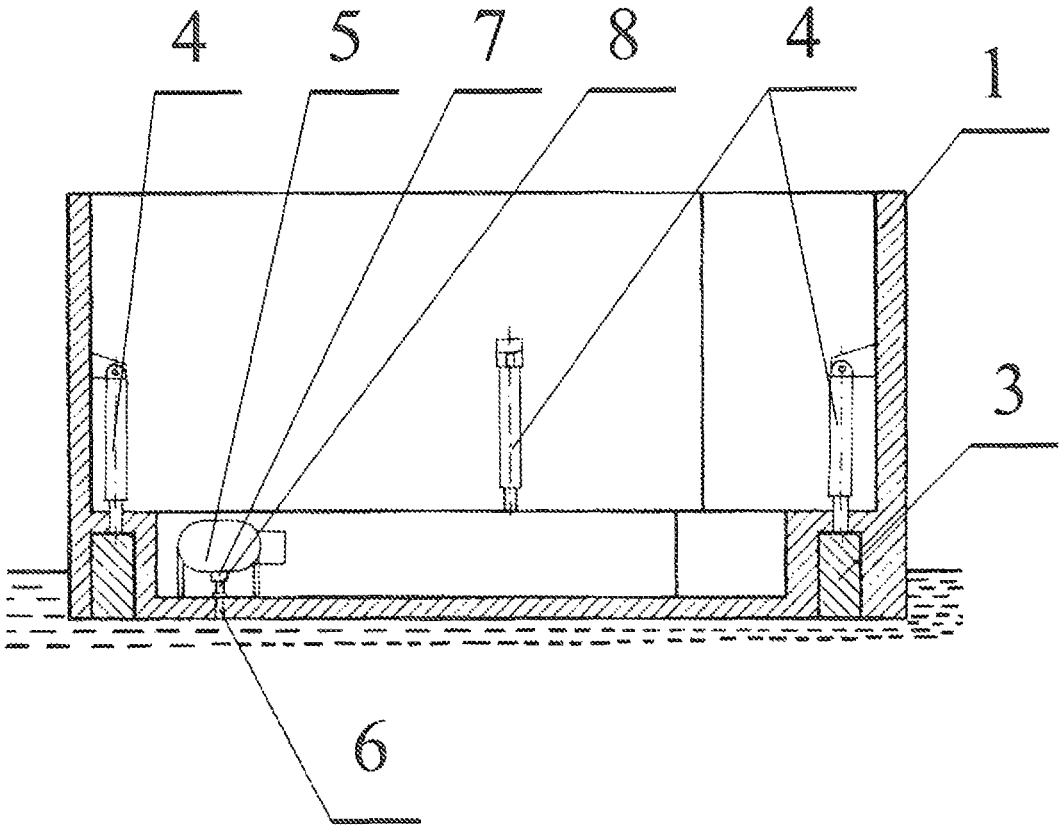
FIG. 2 shows the floating unit in a travelling configuration in the cross-section A-A of FIG. 1.
Figure 3:
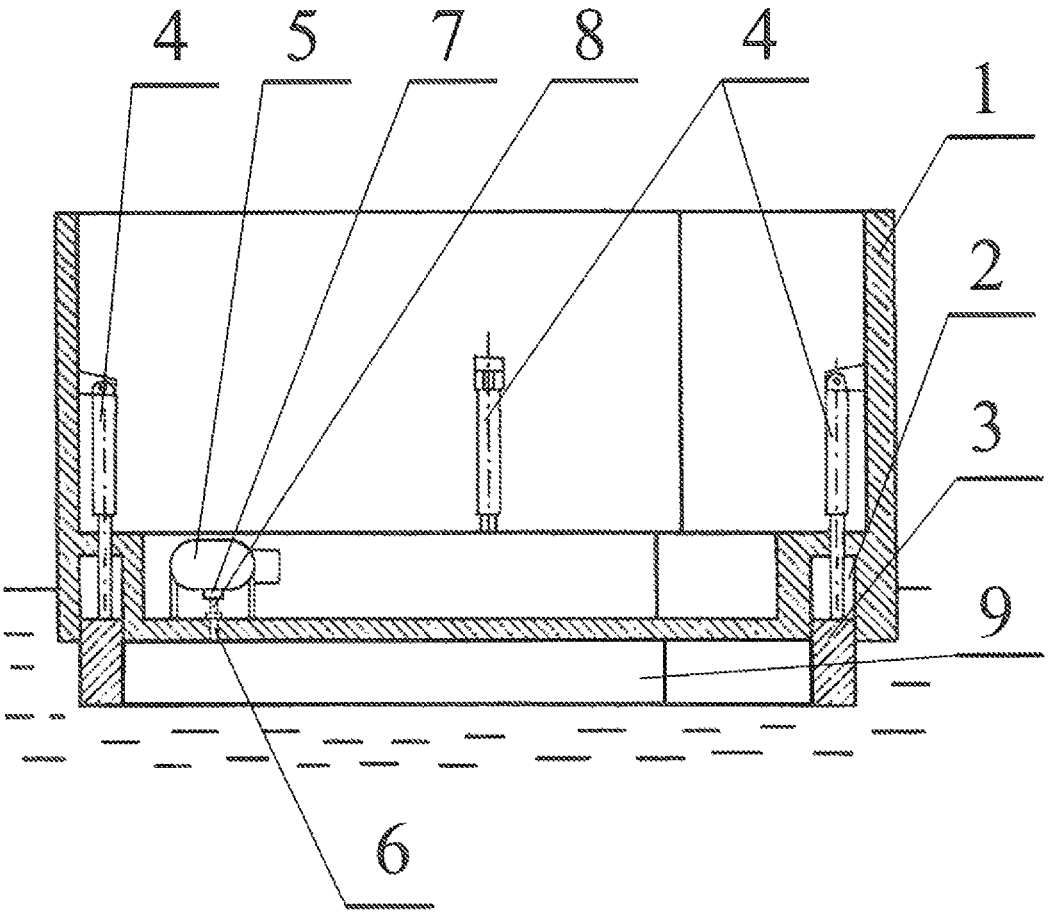
FIG. 3 shows the floating unit in an operating configuration in the cross-section B-B of FIG. 1.
Figure 4:
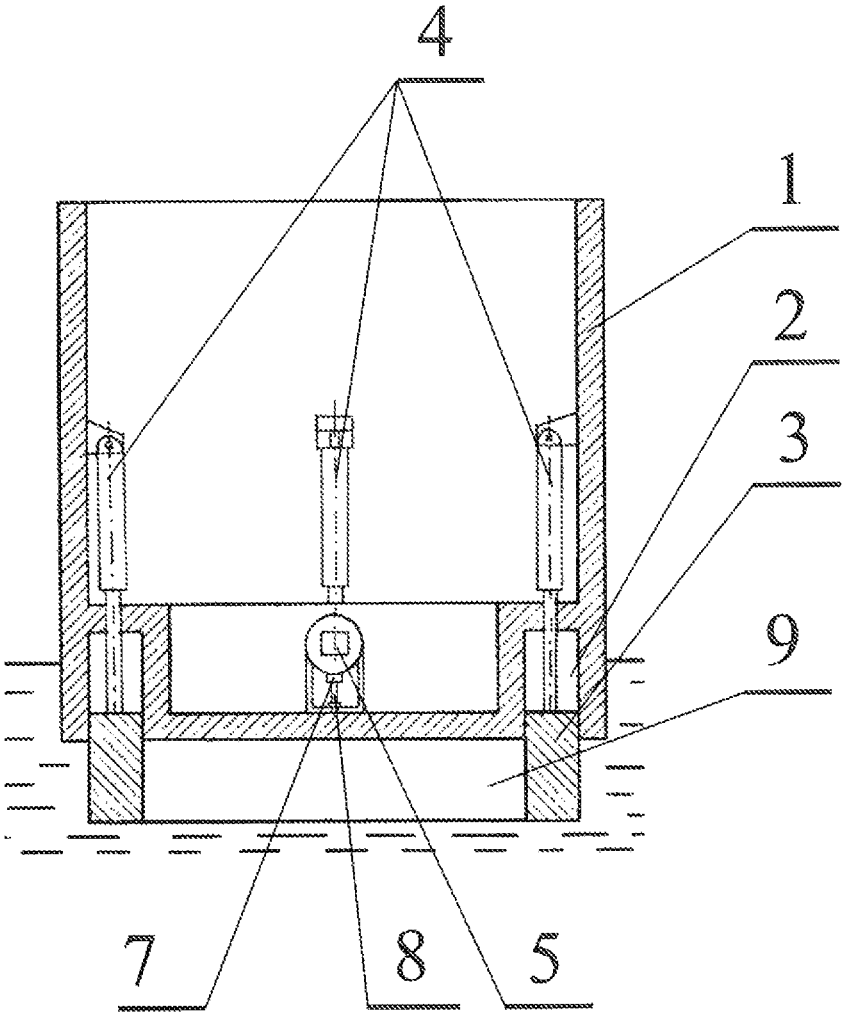
FIG. 4 shows a floating unit in an operating configuration in the cross-section A-A of FIG. 1.

The floating unit with improved resistance to explosions comprises a hull 1 with a recess 2 located at a periphery of its bottom part, in which a wall (shield) 3 is placed together with hydraulic cylinders 4. The hydraulic cylinders 4 are mounted to the hull at one end and to the wall 3 at the other end. The hull 1 comprises a hole 6. The hole 6 is situated in an area of the hull 1 surrounded by the wall 3, as can be seen in the drawings. A compressor unit 5 is connected to the hole 6 through a non-return valve 7 and a hose 8.

The operation of the floating unit with improved resistance to explosions consists in that when the floating unit approaches an offshore zone, where there is an increased risk of occurrence of mines, then the wall 3, by means of the hydraulic cylinders 4, is moved from a first position, in which it is enclosed within the hull 1 in the recess 2 into a second, lower position, thus forming a partly enclosed space, e.g. cavity with variable volume 9. Then, using the compressor unit 5, said cavity is filled with air, which displaces water from the partly enclosed space. Air is provided through the non-return valve 7, the hose 8 and the hole 6, which form a suitable passage. Effectively, the partially enclosed space constitutes an underwater air pocket, that is a space in which the air is trapped under the part of the submerged hull and that remain trapped under normal operating conditions.

The advantage of the floating unit presented herein is that the cavity with the variable volume, created under the bottom of the floating unit and filled with air, works as a shock absorber damping the energy of the mine explosion.

Another advantage is that the shock wave moving from the water through supplied air is weakened, what results in reducing the possible damage of the bottom of the hull. Consequently, the hypothetical damage done by hull's fragments will be lower.

The invention claimed is:

1. A floating unit comprising:

a hull having a recess in which a deployable wall is mounted, the deployable wall being movable between a first and a second position;

wherein in the first position the deployable wall is enclosed within the hull in the recess, and in the second position the deployable wall at least partly protrudes from the hull, thereby defining a partly enclosed space; and wherein the floating unit further comprises means for supplying air to the partly enclosed space, the partly enclosed space being configured to constitute an underwater air pocket upon supplying the air from the means for supplying the air when the floating unit floats in the water with the deployable wall in the second position.

2. The floating unit according to claim 1, wherein means for supplying the air comprise a compressor unit.

3. The floating unit according claim 1, wherein the deployment of the deployable wall is activable by hydraulic cylinders.

* * * * *